United States Patent [19]

Lutz et al.

[11] 4,418,873

[45] Dec. 6, 1983

[54] CUTTING CYLINDER HAVING KNIFE POSITION ADJUSTMENT

[75] Inventors: Bruce L. Lutz, Hesston; Harold W. Voth, Newton; Amos G. Hill, Hesston, all of Kans.

[73] Assignee: Hesston Corporation, Hesston, Kans.

[21] Appl. No.: 326,844

[22] Filed: Dec. 3, 1981

[51] Int. Cl.[3] ..... B02C 18/18

[52] U.S. Cl. ..... 241/294; 241/222

[58] Field of Search ..... 241/221, 222, 223, 238, 241/241, 293, 294

[56] References Cited

U.S. PATENT DOCUMENTS 3,331,561 7/1967 Morkoski et al. ..... 241/294 X 3,946,954 3/1976 Sousek ..... 241/222

*Primary Examiner*—Mark Rosenbaum

*Attorney, Agent, or Firm*—Schmidt, Johnson, Hovey & Williams

[57] ABSTRACT

The cylinder supports a series of knives at its outer periphery which extend generally parallel to the axis of rotation of the cylinder, spanning a plurality of supporting bulkheads that are provided with special mounting assemblies which adjustably attach the knives thereto. The knives are positioned in such a way that in order to adjust the radial position of a cutting edge, the knives are adjustably shifted either inwardly or outwardly in a direction that is normal to the plane of the knives being adjusted. As a result of a degree of inherent flexibility of the knives, certain of the attaching points may be adjustably positioned more inwardly or outwardly than others by causing the knives to flex appropriately at the needed locations. Each attaching or mounting assembly includes a pair of threadably interengaged components, one of which shifts inwardly and outwardly upon rotation of the other so as to correspondingly position the proximal knife portion after a clamping bolt has been sufficiently released.

8 Claims, 5 Drawing Figures

CUTTING CYLINDER HAVING KNIFE POSITION ADJUSTMENT

TECHNICAL FIELD

This invention relates to the field of crop harvesting equipment, and, more particularly, to improvements in the cutting or chopping mechanism utilized in connection with certain harvesters for reducing the rather lengthy stalks, stems, or plants into small segments for livestock feed.

BACKGROUND ART

It is well known that in crop harvesters which utilize a high-speed, rotary cutting cylinder which cooperates with a stationary shear bar, the position of the cutting edge of each knife on the cylinder with respect to the cooperating shear bar is critical if proper cutting is to be achieved with the most efficient use of energy resources. Thus, it is common practice to provide not only a suitable means for shiftably adjusting the shear bar itself toward or away from the periphery of the spinning cylinder, but also to provide for adjustment of each of the knives of the cylinder. Typically, such knife adjustment is provided at several spaced locations along the length thereof in order that spacing problems may be addressed and resolved at several spaced locations along the knife. Due to manufacturing variations and tolerance buildups, it is not at all unlikely that different points along each knife will need to be adjusted by different amounts in order to bring the cutting edges of the knife into proper cutting relationship with the shear bar. Thus, the essentially rigid knives must, to some degree, be capable of flexing slightly to accomodate the fact that one point along the length thereof may be closer to the axis of the cutting cylinder than another point at the next attaching location.

However, typical, conventional cyclinders utilize generally planar knives which are adjusted edgewise inwardly or outwardly in order to accomplish knife edge positioning. Such edgewise adjustment is satisfactory unless it becomes necessary for the edge at one attaching point to be closer to or farther away from the knife supporting structure than other attaching points of the knife. In such situations, the knives must be flexed to the appropriate degree in an edgewise action, generally within their own planes, in order to accomplish the differential positioning. Such edgewise flexing can be difficult to achieve, depending upon the hardness and other characteristics of the knife itself, and can produce undesirable stress in the knives, leading to early fatigue.

SUMMARY OF THE PRESENT INVENTION

Accordingly, one important object of the present invention is to provide a cutting cylinder wherein positioning adjustment of the knives at the attaching points along the latter is carried out by shifting the knives in a direction that is generally normal to the plane of the knife being adjusted, and, if necessary, flexing the particular knife in such direction to the necessary degree, thereby overcoming the problems inherent in so-called edgewise shifting and flexure of conventional knife adjustment arrangements.

Pursuant to the foregoing, the present invention contemplates using a main clamp bolt at each point of attachment along the length of the knife, which, when loosened, permits the rotation of one component threadably engaged with another so that the other component moves outwardly or inwardly as needed to correspondingly shift the knife. For compactness of design, the shifting components are bored therethrough and disposed in coaxial alignment with one another to clearingly receive the clamping bolt. A pair of alternative arrangements are disclosed relating to ways in which the two components may be threadably interengaged.

DETAILED DESCRIPTION

Figure 1:
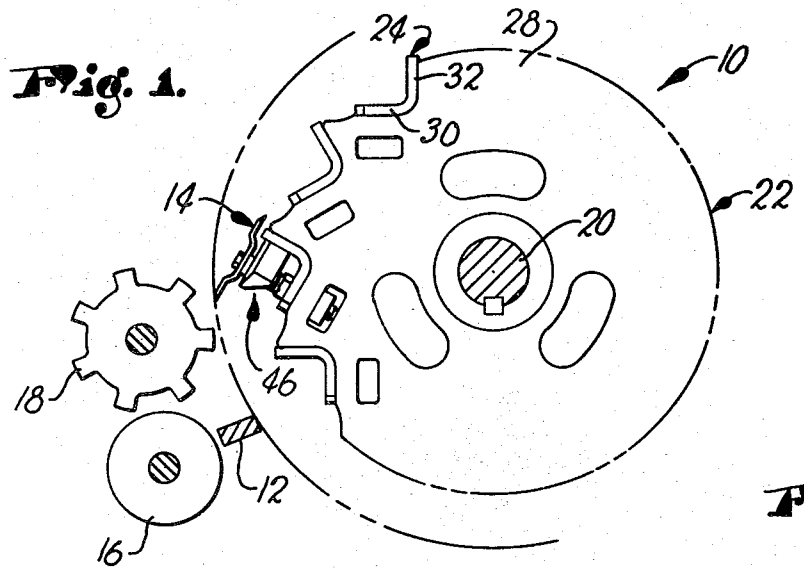
FIG. 1 is a schematic side elevational view of a cutting cylinder and associated crop feed rolls and shear bar, the cylinder having a knife position adjustment construction in accordance with the principles of the present invention.
Figure 2:
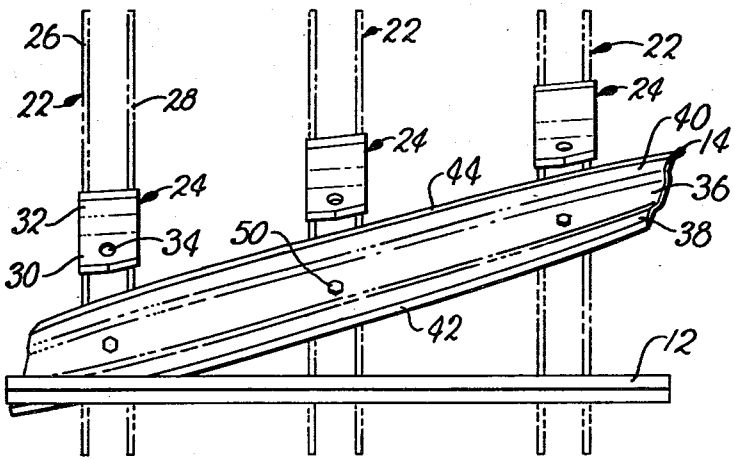
FIG. 2 is a schematic, fragmentary front elevational view thereof with only one knife shown on the cylinder to reveal details of construction.
Figure 4:
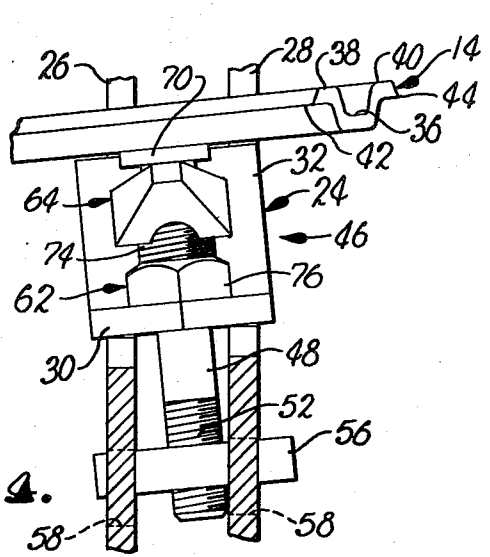
FIG. 4 is a fragmentary cross-sectional view thereof taken substantially along line 4—4 of FIG. 3; and, FIG. 5 is an enlarged, fragmentary cross-sectional view of the cylinder similar to that of FIG. 3, but showing an alternative mounting construction for the knife.
Figure 5:
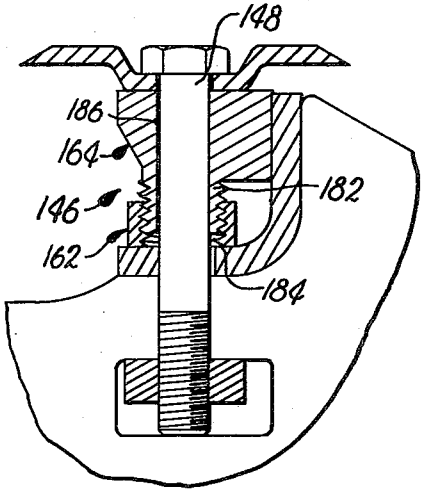
Figure 3:
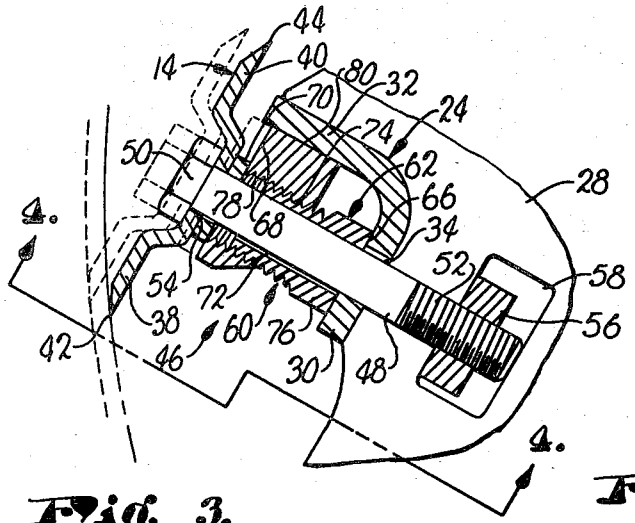
FIG. 3 is an enlarged, fragmentary, transverse cross-sectional view through the cylinder illustrating details of construction and showing in phantom lines an exemplary adjusted position of the knife.

As shown in FIG. 1, the cutting cylinder 10 of the present invention is adapted for use in connection with a shear bar 12 that cooperates with knives 14 of the cylinder 10 during rotation of the latter in a counterclockwise direction to sever into segments crop materials that are fed to the cylinder 10 above the shear bar 12 by a pair of cooperating feed rolls 16 and 18. The cylinder 10 also includes a shaft 20 to which a series of three supporting bulkheads 22 are securely attached for rotation therewith. The bulkheads 22 are spaced apart longitudinally along the shaft 20 and are angularly offset in the direction of rotation of the cylinder 10 to a slight, progressive extent such that, as illustrated in FIG. 2, generally L-shaped seats 24 on the bulkheads 22 are exposed in a staggered pattern. Each of the bulkheads 22 is fabricated from a pair of plates 26 and 28 maintained in slightly spaced apart relationship by a series of the seats 24 attached at peripheral locations on the plates 26, 28 and in circumferentially spaced relationship about the same. As illustrated in FIGS. 1, 3 and 5, the peripheries of the plates 26, 28 are serrated in order to complimentally receive the seats 24 and to dispose the latter in such an attitude that an imaginary line bisecting the angle included by the legs 30 and 32 extends generally radially with respect to the axis of rotation of the cylinder 10. Each leg 30 is provided with an aperture 34 therethrough.

As illustrated herein, each knife 14 is slightly twisted and otherwise formed to extend somewhat helically when attached to the bulkheads 22 in the manner illustrated in FIG. 2. It will be appreciated, however, that such helical orientation is illustrated herein by way of example only and that the knives of the cylinder 10 could, instead, simply extend generally parallel to the axis of rotation of the cylinder 10 either in a continuous structure spanning all three bulkheads 22, or in short, incremental segments. In any event, the knife 14 herein illustrated is of generally planar construction, having a longitudinal depression 36 formed therein for strength purposes. Wings 38 and 40 on opposite, lateral sides of the depression 36 extend along the whole length of the latter and terminate in leading and trailing cutting edges 42 and 44 respectively. Each of the knives 14 is perforated at three locations along the length thereof in the depression 36 corresponding to the spacing between the bulkheads 22. Preferably, the knife 14 is of such design that it can be readily stamped out of plate material and has an inherent flexibility that will enable the same to be flexed to a limited degree in a direction normal to its plane of existence.

Each knife 14 is attached to the bulkheads 22 at three locations along the length thereof, specifically, at the seats 24. In this regard, the mounting means for each knife 14 includes three separate, independently adjustable assemblies, each of which is broadly denoted by the numeral 46. Each assembly 46 includes a clamping bolt member 48 having an enlarged head 50 at the outer end thereof, and a threaded portion 52 at the inner end thereof. Bolt 48 passes through a corresponding hole 54 in the knife 14, through the aperature 34 in the leg 30 of seat 24, into the space between the plates 26 and 28, and extends into a transverse bar element 56 which matingly receives the threaded portion 52. Bar 56 spans the corresponding pair of plates 26, 28 and extends through and slightly beyond generally aligned openings 58 therein. The head 50 of clamping bolt 48 is provided with a series of peripherally disposed wrench flats to facilitate rotation of the bolt 48 in a direction to either thread the same into or out of the bar 56 as may be necessary or desirable.

Each assembly 46 also includes an expandable and contractable shifter 60 interposed between the knife 14 on the one hand and the leg 30 of the seat 24 on the other hand for shifting the knife 14 inwardly or outwardly in a direction normal to the plane thereof when the clamping bolt 48 has been sufficiently released. Each shifter 60 comprises two main components 62 and 64 that are adjustably interengaged so as to effect the desired expansion or contraction of the shifter 60. More particularly, the component 62 has a generally elongated body provided with a flat, inner end 66 that rotatably bears against the outwardly facing bearing surface of leg 30, the component 64 having an opposite, outer end 68 which bears flatly against a washer 70 directly beneath the depression 36 of knife 14. A longitudinally extending bore 72 passes through the body of the component 62 so as to provide clearance for the bolt 48, and a cylindrical shank portion 74 of the component 62 is externally threaded while a base portion 76 thereof has a series of peripherally located, circumferentially extending wrench flats thereabout to facilitate rotation of the component 62.

The component 64 is in the nature of a block having an internally threaded bore 78 that matingly receives the threaded shank portion 74 of the component 62. A rearwardly disposed, flat face 80 of the component 64 slidably bears against the exposed bearing surface of the leg 32.

FIG. 5 illustrates a second embodiment of the present invention wherein the components 162 and 164 of the mounting assembly 146 differ slightly from that shown in FIGS. 1 through 4. Specifically, the component 164, instead of being internally threaded, has an inwardly extending shank portion 182 that is externally threaded and is matingly received by an internally threaded bore 184 of the component 162. A smooth bore 186 extends through the component 164 and longitudinally through the shank portion 182 thereof for clearing the clamping bolt 148. The component 162 has a flatted outer periphery like the component 62 to facilitate the application of a wrench thereto for rotating component 162 during adjustment. No washer is needed between block 164 and knife 14 corresponding to the washer 70 of FIGS. 1–4. In all other respects, the arrangement illustrated in FIG. 5 is the same as that illustrated in FIGS. 1–4.

Operation

In the event that a certain portion of the knife 14 requires adjustment outwardly toward the shear bar 12 as graphically illustrated in FIG. 3 by the phantom lines, the appropriate clamping bolt 48 nearest the knife portion requiring adjustment is first loosened by rotating the same in a direction to withdraw the threaded shank portion 52 from the bar 56. A wrench or the like may then be applied to the base portion 76 of the component 62 associated with the loosened bolt 48, and by rotating the component 62 in the appropriate direction, the associated component 64 will be advanced outwardly, riding along the bearing surface of the leg 32 of seat 24. This has the effect of expanding the shifter 60 to take up the slack which has been presented in the assembly 46 by the loosened bolt 48, thereby causing the involved portion of the knife 14 to move outwardly to the phantom line position of FIG. 3 in a direction that is normal to the plane of the knife 14. In view of the fact that the knife 14 is oriented at a substantial acute angle with an imaginary line which is tangent to the arc described by the leading cutting edge 42 when the cylinder 10 is rotated, outward movement of the knife 14 as above described results in a corresponding slight outward movement of the cutting edge 42 with respect to the axis of rotation of the cylinder 10. Once the knife portion in question has been moved outwardly to the desired extent, the bolt 48 can be retightened, and the cylinder 10 is ready for further operation. Inward movement of the knife 14, or a portion thereof, can be accomplished by simply rotating the component 62 in the opposite direction of that above described after loosening the bolt 48 such that the shifter 60 will effectively contract and allow the bolt 48 to be drawn inwardly by the bar 56 to a greater extent when the bolt 48 is tightened down.

It is to be noted that position adjustment of the cutting edge 42 with respect to the shear bar 12 can be made at any or all of the three points of attachment of the knife 14 to the supporting bulkheads 22. In the event that the entire knife edge 42 throughout its length needs to be properly positioned with respect to the shear bar 12, all three of the mounting assemblies 46 should be manipulated. On the other hand, if only one of three points of each knife edge 42 requires positioning adjustment, only that appropriate assembly 46 is manipulated and the inherent resiliency of the knife 14 in a direction normal to its plane of existence is relied upon to permit the necessary movement of that particular portion of the knife 14 relative to the other, nonadjusted portions thereof.

Adjustment of the arrangement illustrated in FIG. 5 is carried out in precisely the same manner as that embodiment of FIGS. 1–4. Loosening the bolt 148 permits the operator to rotate the component 162, causing the component 164 to be threaded inwardly or outwardly, depending upon the direction of rotation of the component 162 so as to either shift the knife 14 outwardly or permit its return inwardly when the bolt 148 is retightened.

In the event that the leading edge 42 of a certain knife 14 becomes so dull that it cannot be properly resharpened, the particular knife 14 in question may be entirely removed from the bulkheads 22 by completely withdrawing the bolts 48 from the bars 56. Thereupon, the knife 14 in question may be turned end-for-end such that the trailing edge 44 now becomes the leading edge and the edge 42 now becomes the trailing edge. Replacement and retightening of the bolt 48 once again prepares the cylinder 10 for operation, at which time it is likely that minor positional adjustments will be required, but these can be easily and quickly carried out in view of the nature of the mounting assemblies 46 as above described.

Also of significance with respect to the present invention is the manner in which the mounting assemblies 46 and 146 are "pre-loaded" to best resist the impact load experienced during high speed crop severance. In this regard, and using the assembly 46 as an example, the various surfaces of the block 64, both internal and external, are so related to each other and to the aperture 34 that the block 64 forces the bolt 48 to forcibly bear against the loading, front wall portion of the aperture 34 when bolt 48 is tightened down. Accordingly, there is a significantly decreased opportunity to slippage and wear of the bolt 48 within and around the aperture 34.

We claim:

1. In a rotary cutter for reducing crop material into segments, the improvement comprising:

a generally flat knife having a longitudinal cutting edge;

a rotary support for the knife; and means mounting said knife on the support with said cutting edge leading with respect to the direction of rotation of the support, said mounting means including structure rendering the knife adjustably shiftable in a direction substantially normal to the flat plane of the knife for selective repositioning of said cutting edge with respect to the axis of rotation of the cutter, said structure including a releasable retainer holding said knife on the support, and a shifter operably coupled with the knife for effecting said adjustable shifting of the knife when said retainer is released, said shifter including a pair of interengaged relatively expandable and retractable components positioned between said knife and the support, said components being threadably interengaged whereby relative rotation between the same produces said expansion or retraction of the shifter, each of said components being provided with a bore therethrough which is coaxially aligned with the bore of the other component, said retainer including an elongaged, threaded member passing through said bores and through said knife, said member having an enlargement at the outer end thereof and a matingly threaded element at the inner end thereof engageable with said support and operable to cause said enlargement to be drawn tightly against said knife when the member and the element are relatively rotated in a certain direction.

2. In a rotary cutter as claimed in claim 1, wherein said structure includes a plurality of independently adjustable assemblies spaced along the length of said knife.

3. In a rotary cutter as claimed in claim 2, wherein said knife is inherently sufficiently flexible in said normal direction to permit flexure positioning of certain portions thereof at different distances from said axis.

4. In a rotary cutter as claimed in claim 1, wherein said support includes a pair of flat, bearing surfaces disposed at right angles to one another, one of said surfaces underlying a rotatable one of said components and the other of said surfaces slidably engaging the other of said components during axial shifting thereof.

5. In a rotary cutter as claimed in claim 4, wherein said one component is provided with a series of peripherally disposed flat faces.

6. In a rotary cutter as claimed in claim 4, wherein said one component is provided with a threaded shank portion which is threadably received by said bore of the other component.

7. In a rotary cutter as claimed in claim 4, wherein said other component is provided with a threaded shank portion which is threadably received by said bore of the one component.

8. In a rotary cutter as claimed in claim 4, wherein said one surface is provided with an aperture therethrough for clearing said threaded member, said other component being so disposed by said other surface of the support as to cause said threaded member to forcibly bear against an outwardly leading wall portion of said aperture.

* * * * *